US009635995B2

(12) United States Patent
Bhajak et al.

(10) Patent No.: US 9,635,995 B2
(45) Date of Patent: May 2, 2017

(54) DISHWASHER SUPPORT STRUCTURES

(71) Applicant: Whirlpool Corporation, Benton Harbor, MI (US)

(72) Inventors: Harshal J. Bhajak, Pune (IN); Rexford W. Cordill, Granger, IN (US); Steven J. Kuehl, Stevensville, MI (US); Thomas M. O'Brien, Saint Joseph, MI (US); Donald J. Wilson, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/153,134

(22) Filed: May 12, 2016

(65) Prior Publication Data

US 2016/0256032 A1 Sep. 8, 2016

Related U.S. Application Data

(63) Continuation of application No. 13/939,462, filed on Jul. 11, 2013, now Pat. No. 9,357,899.

(60) Provisional application No. 61/717,139, filed on Oct. 23, 2012.

(51) Int. Cl.

| | |
|---|---|
| ***A47B 77/08*** | (2006.01) |
| ***A47L 15/42*** | (2006.01) |
| ***A47L 15/22*** | (2006.01) |
| ***A47L 15/50*** | (2006.01) |

(52) U.S. Cl.

CPC ..... *A47L 15/4272* (2013.01); *A47L 15/22* (2013.01); *A47L 15/4225* (2013.01); *A47L 15/4246* (2013.01); *A47L 15/4285* (2013.01); *A47L 15/4293* (2013.01); *A47L 15/507* (2013.01)

(58) Field of Classification Search

CPC .. A47L 15/4272; A47L 15/4251; A47L 15/50; A47L 15/504; A47L 15/506; A47L 15/507; A47L 15/22; A47L 15/4225; A47L 15/4246; A47L 15/4285; A47L 15/4293; A47B 88/0014; A47B 88/04; A47B 2210/0059; A47B 2210/0067; A47B 2210/007

USPC ..... 312/228, 228.1, 257.1, 330.1, 312/265.1–265.4, 264, 265.5, 265.6

See application file for complete search history.

(56) References Cited

U.S. PATENT DOCUMENTS

| | | | |
|---|---|---|---|
| 2,843,444 | A | 7/1958 | Nelson |
| 3,376,087 | A | 4/1968 | Hardy |
| 3,390,930 | A | 7/1968 | Peterson |

(Continued)

FOREIGN PATENT DOCUMENTS

| | | |
|---|---|---|
| EP | 1800590 | 6/2007 |
| EP | 1935323 | 6/2008 |

(Continued)

*Primary Examiner* — Daniel J Troy
*Assistant Examiner* — Timothy M Ayres
(74) *Attorney, Agent, or Firm* — Diederiks & Whitelaw, PLC

(57) ABSTRACT

Support structures for dishwashers are disclosed. An example dishwasher for treating dishes according to a cycle of operation includes a tub defining a treating chamber with an opening, a frame coupled to and structurally supporting at least a portion of the tub, a dish rack mount coupled to the frame, and a dish rack coupled to the dish rack mount, wherein the weight of the dish rack is substantially borne by the frame.

17 Claims, 10 Drawing Sheets

(56) References Cited

U.S. PATENT DOCUMENTS

| | | | | |
|---|---|---|---|---|
| 3,799,640 | A | 3/1974 | Jacobs | |
| 3,804,483 | A | 4/1974 | Afful et al. | |
| 3,811,746 | A * | 5/1974 | Butsch | A47L 15/4246 312/228 |
| 3,834,784 | A * | 9/1974 | Butsch | A47L 15/507 312/350 |
| 4,295,692 | A | 10/1981 | Jenkins | |
| 4,359,250 | A | 11/1982 | Jenkins | |
| 5,785,402 | A | 7/1998 | DeLorenzo | |
| 5,787,911 | A | 8/1998 | Jacobus et al. | |
| 6,247,771 | B1 | 6/2001 | Miller | |
| 6,546,942 | B2 | 4/2003 | Smith et al. | |
| 7,168,578 | B2 | 1/2007 | Mersch et al. | |
| 7,594,513 | B2 | 9/2009 | VanderRoest et al. | |
| 7,594,707 | B2 | 9/2009 | Kunkle et al. | |
| 7,731,309 | B2 * | 6/2010 | Gorini | A47L 15/4229 312/228 |
| 7,731,805 | B2 | 6/2010 | Banta et al. | |
| 7,815,265 | B2 | 10/2010 | Lee | |
| 7,954,913 | B2 | 6/2011 | Gunnerson et al. | |
| 7,984,812 | B2 | 7/2011 | Pike et al. | |
| 8,192,557 | B2 | 6/2012 | Ryu et al. | |
| 9,357,899 | B2 * | 6/2016 | Bhajak | A47L 15/4272 |
| 2003/0042825 | A1 | 3/2003 | Welch et al. | |
| 2009/0205378 | A1 * | 8/2009 | Helgesen | A47L 15/4251 68/3 R |

FOREIGN PATENT DOCUMENTS

| | | |
|---|---|---|
| EP | 1982633 | 12/2010 |
| WO | 2011/013057 | 2/2011 |

* cited by examiner

DISHWASHER SUPPORT STRUCTURES

CROSS REFERENCE TO RELATED APPLICATIONS

This application represents a continuation of U.S. patent application Ser. No. 13/939,462, filed on Jul. 11, 2013 and titled "Dishwasher Support Structures", which claims the benefit of U.S. Provisional Patent Application Ser. No. 61/717,139, filed on Oct. 23, 2012 and titled "Dishwasher Support Structures". The entire content of these applications is incorporated herein by reference.

FIELD OF THE INVENTION

This disclosure relates generally to dishwashers, and, more particularly, to support structures for dishwashers.

BACKGROUND

Dishwashers may have a configuration based on a tub that defines a treating chamber in which items are placed for cleaning and/or drying according to a cycle of operation. A dispensing system may be provided for dispensing a treating chemistry as part of the cycle of operation. A controller may be operably connected with the dispensing system and various other components of the dishwasher to execute the cycle of operation. The cycle of operation may be selected manually by the user or automatically based on one or more conditions determined by the controller.

SUMMARY

An example dishwasher for treating dishes according to a cycle of operation includes a tub defining a treating chamber with an opening, a frame coupled to and structurally supporting at least a portion of the tub, a dish rack mount coupled to the frame, and a dish rack coupled to the dish rack mount, wherein the weight of the dish rack is substantially borne by the frame.

DETAILED DESCRIPTION

Figure 1:
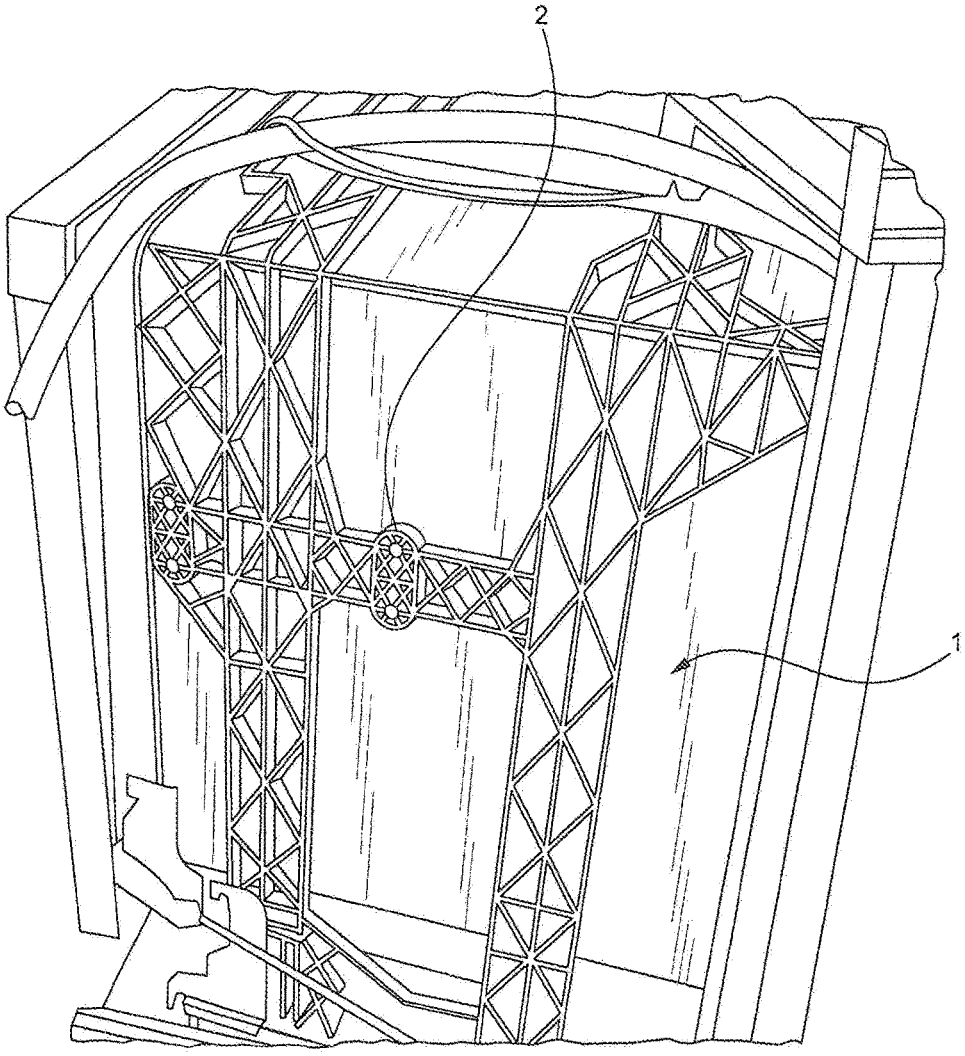
FIG. 1 (Prior Art)
FIG. 1 is an image of an example prior-art dishwasher tub.

The example prior art dishwasher tub 1 of FIG. 1 is formed of plastic via an injection molding process to include bracing 2 that provides rigidity and support for dish racks mounted inside the tub 1. The bracing 2 is an integral part of the tub 1 and dish rack mounts and dish racks are coupled to the bracing 2. Thus, the tub 1 via the bracing 2 supports the weight of the dish racks. Such dish racks, when loaded with dishes, can weigh as much as 30 pounds (lbs). Because the plastic used to form the tub 1 and bracing 2 becomes softer as the temperature of water used to wash dishes increases, a substantial amount of bracing 2 is conventionally required to ensure the tub 1 remains structurally sound. The use of injection molding and the additional plastic required to form the bracing 2 increases the manufacturing cost of the tub 1.

Figure 2:
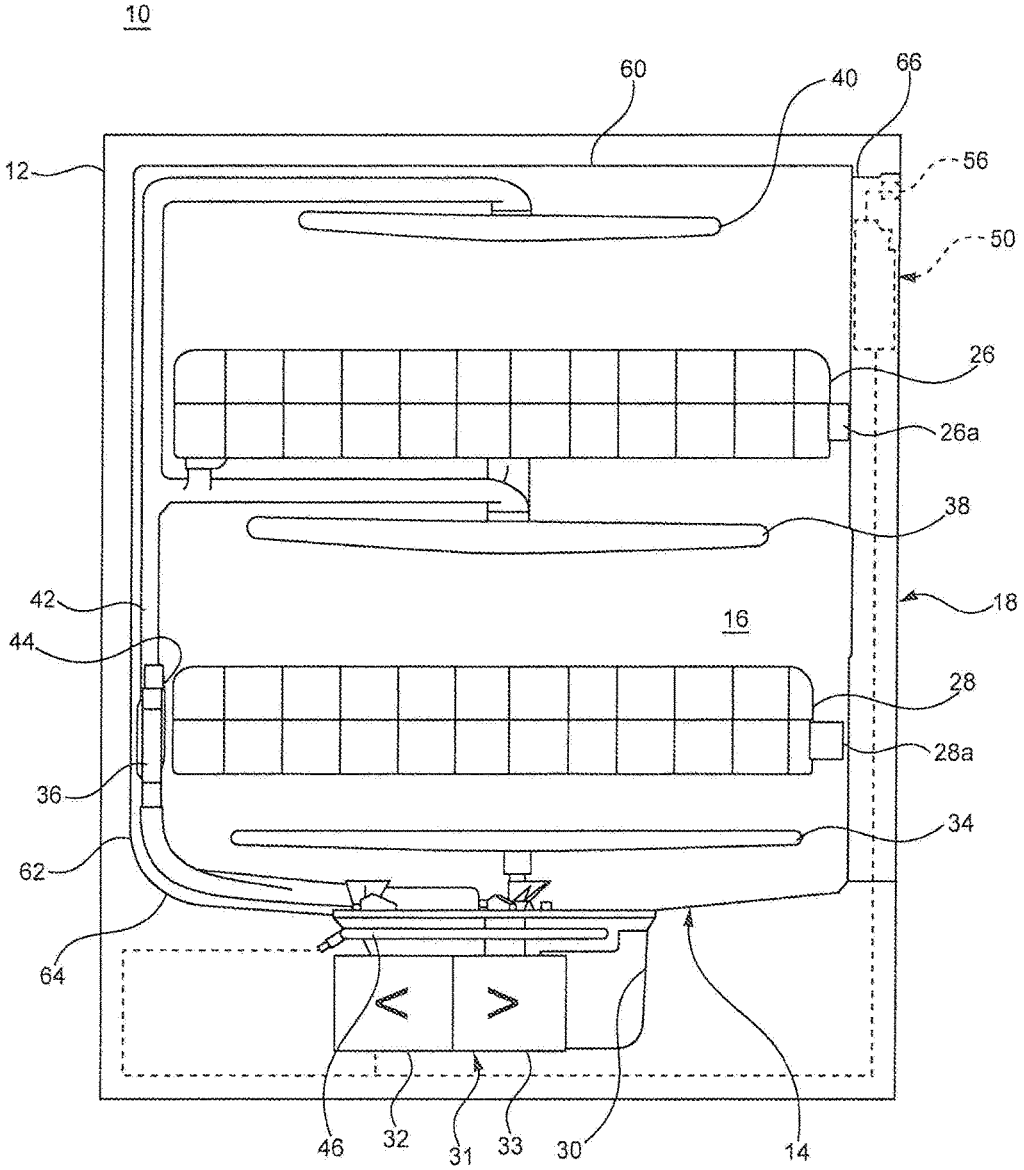
FIG. 2 is a schematic, side cross-sectional view of an example dishwasher.

In FIG. 2, an automated dishwasher 10 according to a disclosed embodiment is illustrated. The dishwasher 10 shares many features of a conventional automated dishwasher, which will not be described in detail herein except as necessary for a complete understanding. A chassis or frame 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items. Example manners of implementing the chassis or frame 12 are described below in connection with FIGS. 4-18.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes or other items for washing and/or drying. The upper and lower racks 26, 28 may be mounted to dish rack mounts 26*a*, 28*a* via disk rack rails for slidable movement in and out of the treating chamber 16 for ease of loading and unloading. Other dish holders may be provided, such as a silverware basket. As used in this disclosure, the term "dish(es)" is intended to be generic to any item, single or plural, that may be treated in the dishwasher 10, including, without limitation, dishes, plates, pots, bowls, pans, glassware, utensils, and silverware. The dish rack mounts 26*a*, 28*a* are coupled to chassis or frame 12 so that the weight of the dish racks 26, 28 is borne by the chassis or frame 12 rather than by the tub 14. That is, the dish rack mounts 26*a*, 28*a* are coupled to the chassis or frame 12 via fasteners that pass through the tub 14 but need not or do not transfer meaningful weight to the tub 14. Thus, the tub 14 need not have sufficient rigidity or strength to support the weight of the dish racks 26, 28, as is required by conventional dishwashers. Accordingly, the tub 14 may be manufactured by thermally forming a sheet of plastic rather than injection molding, thus, lowering the manufacturing costs of the tub 14. Alternatively, the tub 14 may be manufactured using other materials such as stainless steel.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 3:
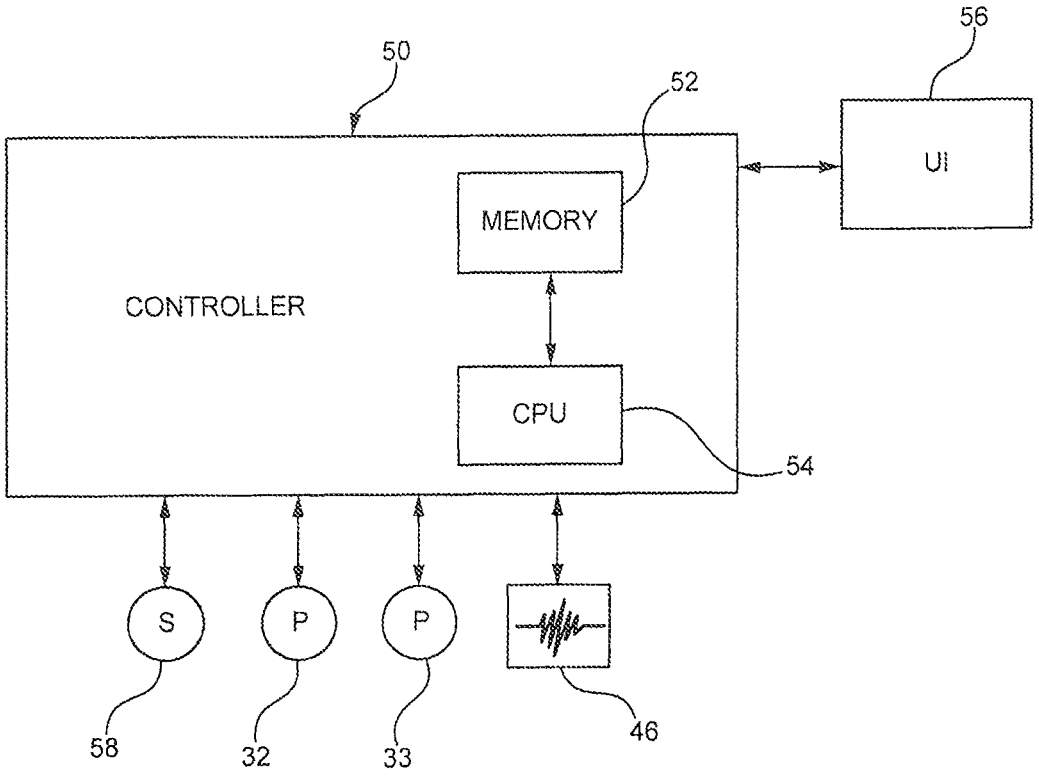
FIG. 3 is a schematic view of the controller of the example dishwasher of FIG. 2.

As illustrated schematically in FIG. 3, the controller 50 may be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

Figure 4:
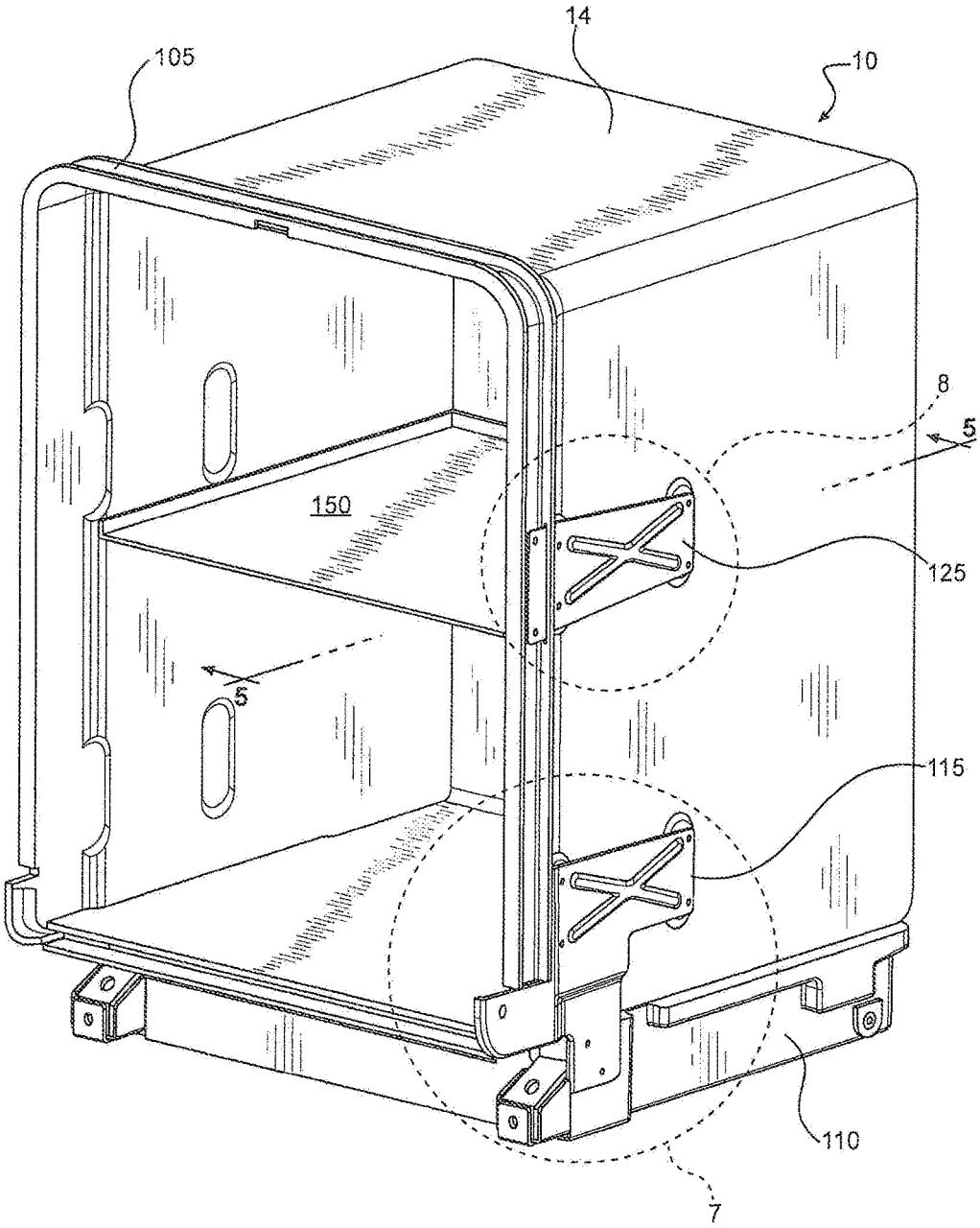
FIG. 4 is an isometric view of a support structure for the example dishwasher of FIG. 2.

FIG. 4 illustrates an example manner of implementing the chassis or frame 12 of FIG. 2. To support the open face of the tub 14, the chassis or frame 12 includes a collar 105. As shown more clearly in FIGS. 5 and 6, the collar 105 may be a U-shaped channel formed to at least partially surround three sides of the tub 14.

Returning to FIG. 4, to support the dishwasher 10, the example chassis or frame 12 includes a base 110. The base supports the dishwasher 10 and transfers the weight of the dishwasher 10 to a surface such as a floor beneath the dishwasher 10.

To couple the collar 105 and the base 110, the example chassis or frame 12 includes a lower bracket 115. The example lower bracket 115 couples the collar 105 to the base 110, and transfers weight from the collar 105 to the base 110. As shown more clearly in FIG. 7, an end of the collar 105 may be attached to the lower bracket 115 using welds, screws, bolts, rivets or metal clinching joints, and the lower bracket 115 may be coupled to the base 110 via, for example, welds, screws, bolts, rivets, or metal clinching joints. The lower bracket 115 may bear and transfer the weight of the lower dish rack mount **28*a* of FIG. 2 to the base 110. The lower dish rack mount 28*a* may be coupled to the lower bracket 115 via fasteners that pass through the tub 14 but need not or do not transfer meaningful weight to the tub 14. The fasteners engage holes 120 in the lower bracket 115**.

Figure 5:
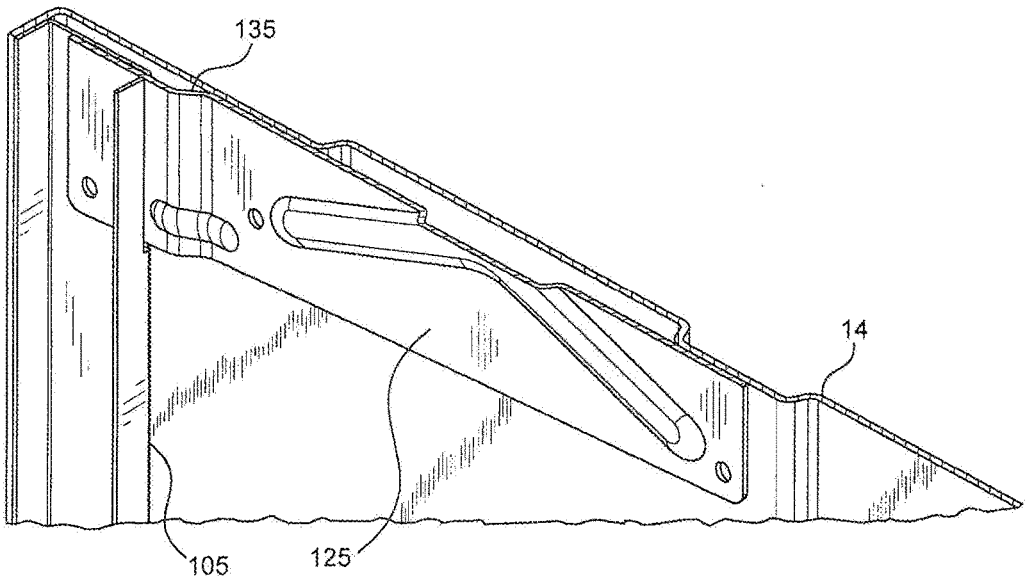
FIG. 5 is an isometric cross-sectional view taken along line 5-5 of FIG. 4.
Figure 6:
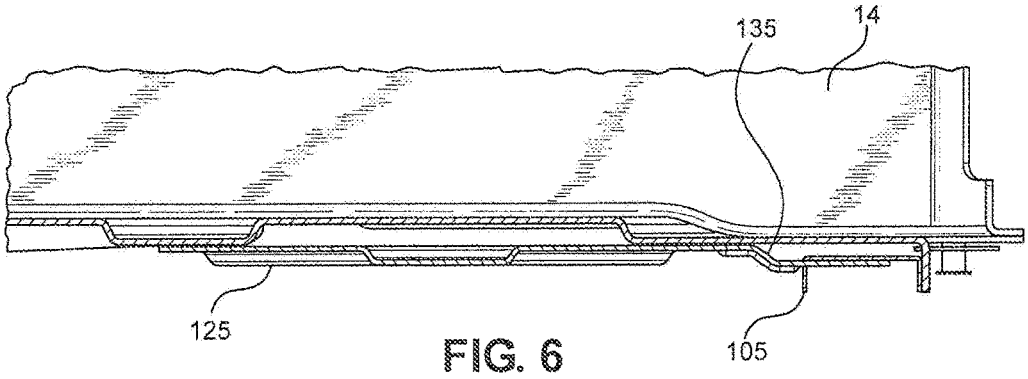
FIG. 6 is a top cross-sectional view taken along line 5-5 of FIG. 4.

Returning to FIG. 4, to support the upper dish rack mount **26*a* of FIG. 2, the example chassis or frame 12 includes an upper bracket 125. The upper bracket 125 bears and substantially transfers the weight of the upper dish rack mount 26*a* of FIG. 2 to the collar 105 and thus to the base 110 via the lower bracket 115. The upper dish rack mount 26*a* is coupled to the upper bracket 125 via fasteners that pass through the tub 14 but need not or do not transfer meaningful weight to the tub 14. As shown more clearly in FIG. 8, the fasteners engage holes 130 in the upper bracket 125. The upper bracket 125 may extend through a slot in the collar 105 and may be fastened to the collar 105 using, for example, welds, screws, bolts, rivets, or metal clinching joints. An example metal clinching joint is a TOX® joint. As shown in FIGS. 5, 6 and 9, the upper bracket 125 may include an offset 135 that aligns one end of the upper bracket 125 with the collar 105 and an opposite end of the upper bracket 125 with the tub 14**.

Figure 7:
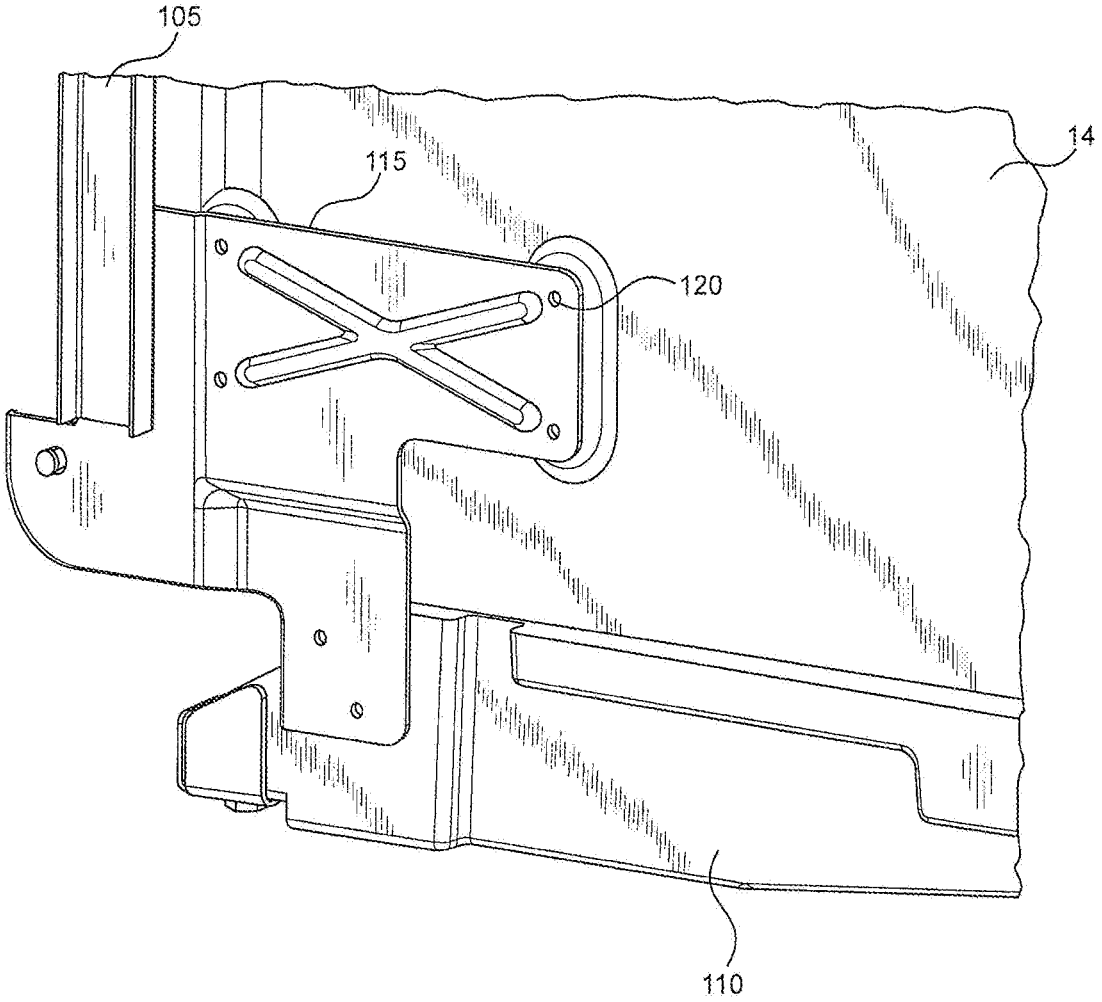
FIG. 7 is an enlarged view of the portion 7 of FIG. 4.
Figure 8:
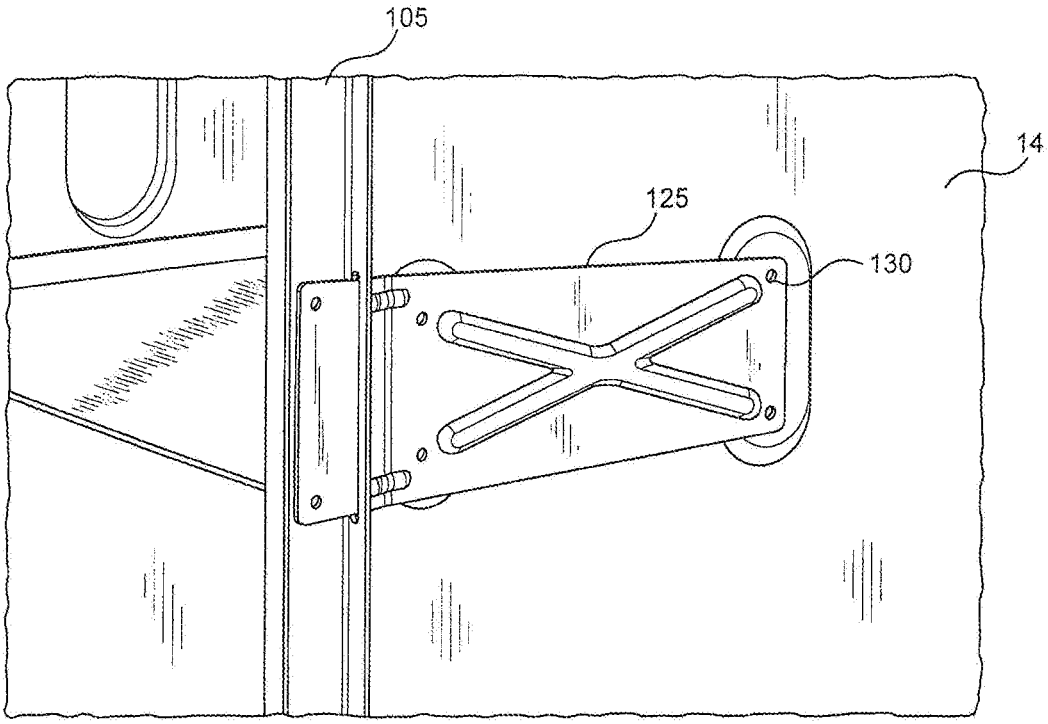
FIG. 8 is an enlarged view of the portion 8 of FIG. 4.
Figure 9:
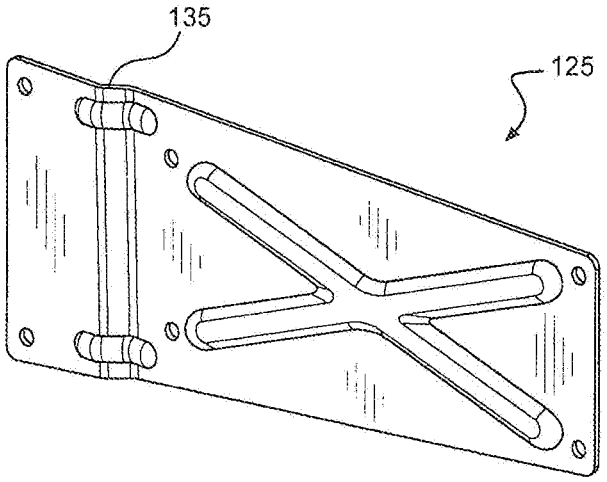
FIG. 9 is an isometric view of the example upper bracket of FIG. 4.

As shown in FIGS. 7-9, the upper and lower brackets 115, 125 may include raised portions to increase or enhance strength and/or rigidity.

Figure 10:
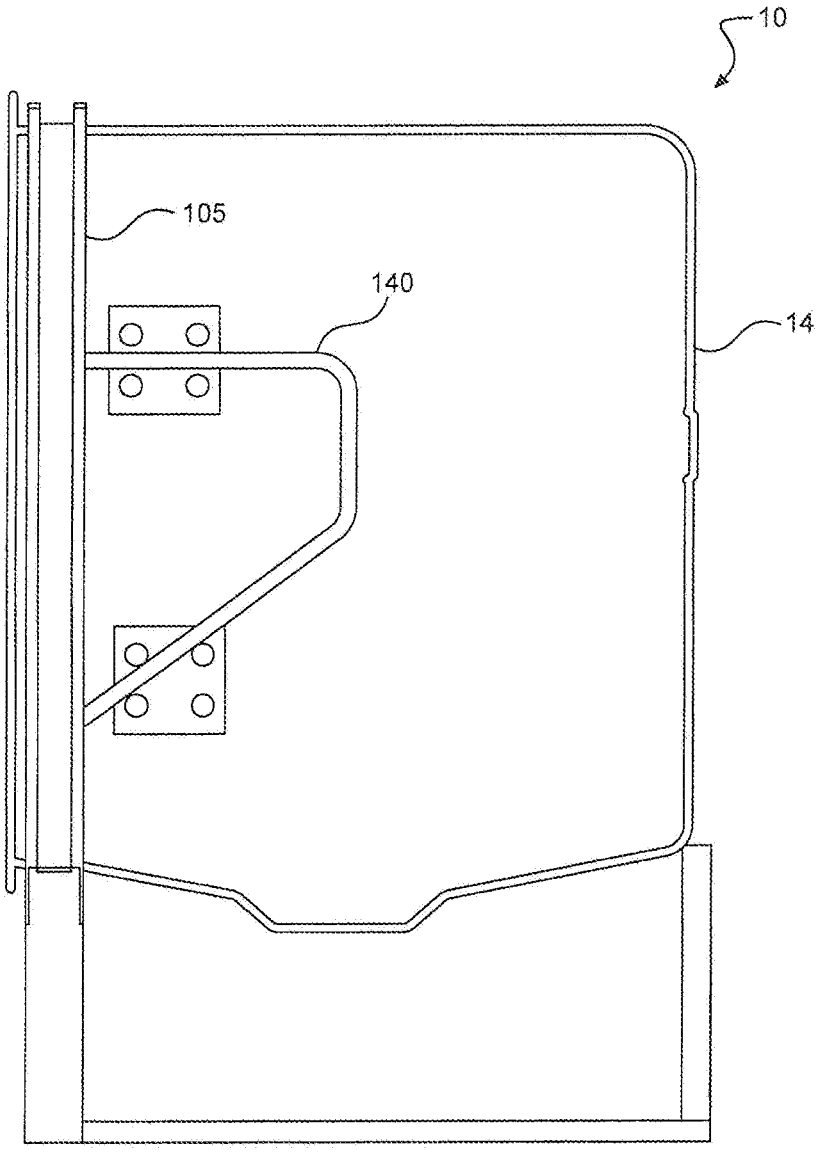
FIG. 10 is a schematic diagram of another example support structure for the example dishwasher of FIG. 2.
Figure 11:
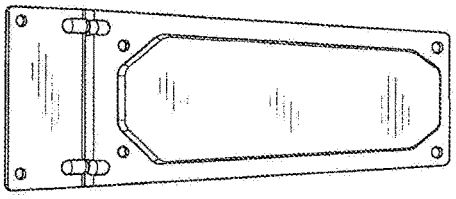
FIGS. 11-16 are diagrams of other alternative upper brackets that may be used in the example support structure of FIG. 4.
Figure 12:
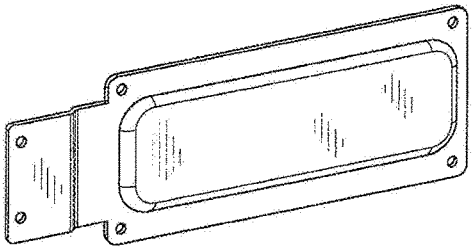
Figure 13:
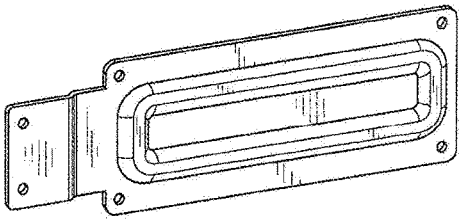
Figure 14:
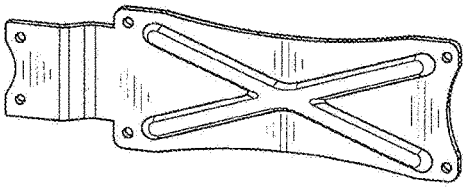
Figure 15:
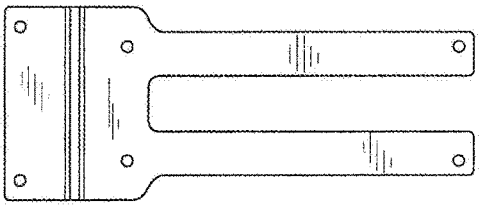
Figure 16:
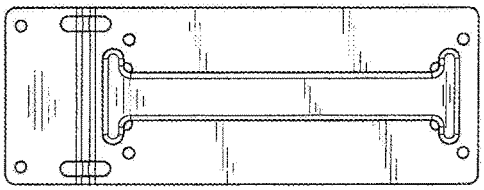

While an example support structure is illustrated in FIGS. 4-9, other support structures may be used to bear and substantially transfer the weight of dish racks to the chassis or frame 12. For example, as illustrated in FIG. 10, a U-shaped tubular support member 140 coupled at both ends to the collar 105 may be used to support the upper and lower dish rack mounts **26*a*, 28*a***.

FIGS. 11-16 illustrate non-limiting alternative upper brackets 125 that may be used with the example chassis or frame 12 of FIG. 2.

Figure 17:
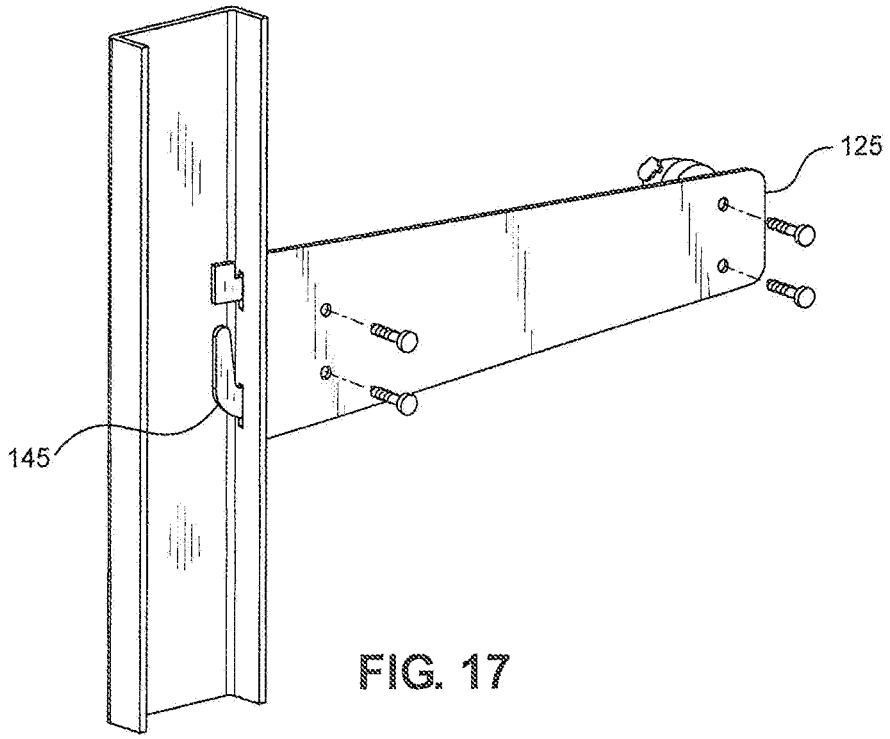
FIGS. 17 and 18 are isometric views of alternative couplings between the example upper bracket and the example collar of FIG. 4.
Figure 18:
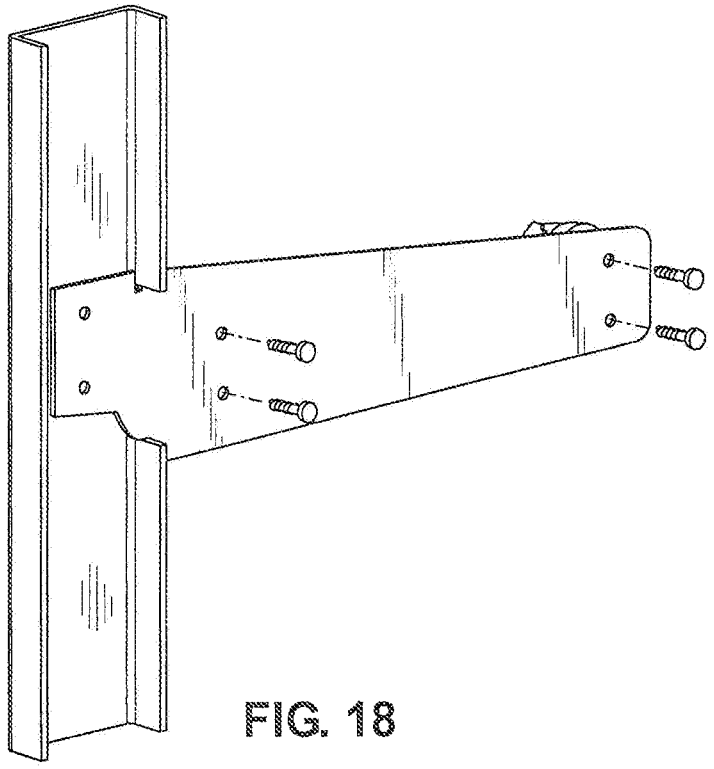

FIGS. 17 and 18 illustrate non-limiting alternative couplings of the upper bracket 125 and the collar 105. For example, as shown in FIG. 17, the upper bracket 125 may have tabs 145 that engage corresponding slots in the collar 105, and may have geometries and/or may be bent after installation to prevent the upper bracket 125 from becoming uncoupled to the collar 105.

While not shown in FIGS. 2-18, the brackets 115 and 125, and support member 140 may be used to support the weight of other elements of the dishwasher 10. For example, the upper bracket 125 may be used to support a divider such as a divider 150 shown in FIG. 4.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

the invention claimed is:

1. A dishwasher comprising:

a tub defining a treating chamber, the tub including an opening and opposing sidewalls;

a collar coupled to the tub, the collar being formed separately from the tub and located outside the treating chamber, wherein the collar includes a first wall extending from a first one of the opposing sidewalls in a direction perpendicular to the first one of the opposing sidewalls, and wherein a first slot and a second slot are formed in the first wall;

a first bracket coupled to the collar, the first bracket being located adjacent to the first one of the opposing sidewalls and including a first end and a second end, wherein the first end of the first bracket includes a first tab extending through the first slot and a second tab extending through the second slot;

a first dish rack mount coupled to the first bracket; and a first dish rack coupled to the first dish rack mount, wherein the collar is configured to bear the weight of the first dish rack.

2. The dishwasher of claim 1, wherein the first bracket and the first dish rack mount are configured to transfer the weight of the first dish rack to the collar.

3. The dishwasher of claim 1, wherein the first bracket is located outside the treating chamber.

4. The dishwasher of claim 1, wherein the collar is coupled to the tub around the opening.

5. The dishwasher of claim 1, wherein the tub comprises a thermal formed plastic.

6. The dishwasher of claim 1, wherein the collar further includes a second wall extending from the first one of the opposing sidewalls in a direction perpendicular to the first one of the opposing sidewalls and a third wall parallel to the first one of the opposing sidewalls, the first, second and third walls defining a U-shape.

7. The dishwasher of claim 1, further comprising:

a second bracket coupled to the collar, the second bracket being located adjacent to the first one of the opposing sidewalls;

a second dish rack mount coupled to the second bracket; and a second dish rack coupled to the second dish rack mount, wherein the collar is configured to bear the weight of the second dish rack.

8. The dishwasher of claim 1, further comprising:

a base coupled to the collar, the base being formed separately from the tub and configured to transfer the weight of the dishwasher to a surface beneath the dishwasher.

9. A dishwasher comprising:

a tub defining a treating chamber, the tub including an opening and opposing sidewalls;

a collar coupled to the tub, the collar being formed separately from the tub and located outside the treating chamber;

a first dish rack mount located adjacent to a first one of the opposing sidewalls;

a second dish rack mount located adjacent to the first one of the opposing sidewalls;

a first dish rack coupled to the first dish rack mount;

a second dish rack coupled to the second dish rack mount; and a support member coupled to the collar, the first dish rack mount and the second dish rack mount, wherein the collar is configured to bear the weight of the first and second dish racks, and wherein the support member is located outside the treating chamber.

10. The dishwasher of claim 9, wherein the support member is configured to transfer the weight of the first and second dish racks from the first and second dish rack mounts to the collar.

11. The dishwasher of claim 9, wherein the support member is U-shaped.

12. The dishwasher of claim 11, wherein the support member includes a first end coupled to the collar and a second end coupled to the collar.

13. The dishwasher of claim 9, wherein the support member is tubular.

14. The dishwasher of claim 9, wherein the collar is coupled to the tub around the opening.

15. The dishwasher of claim 9, wherein the tub comprises a thermal formed plastic.

16. The dishwasher of claim 9, wherein the collar includes:

a first wall extending from the first one of the opposing sidewalls in a direction perpendicular to the first one of the opposing sidewalls;

a second wall extending from the first one of the opposing sidewalls in a direction perpendicular to the first one of the opposing sidewalls; and a third wall parallel to the first one of the opposing sidewalls, the first, second and third walls defining a U-shape.

17. The dishwasher of claim 9, further comprising:

a base coupled to the collar, the base being formed separately from the tub and configured to transfer the weight of the dishwasher to a surface beneath the dishwasher.

* * * * *